US008057272B1

(12) United States Patent
Wray et al.

(10) Patent No.: US 8,057,272 B1
(45) Date of Patent: Nov. 15, 2011

(54) INFANT FLOTATION DEVICE

(75) Inventors: Tina Wray, Walker, MI (US); Jeremy Wray, Walker, MI (US); Jane Bazan, Mesa, AZ (US); David Bazan, Mesa, AZ (US)

(73) Assignee: Right Side Up LLC, Walker, MI (US)

( * ) Notice: Subject to any disclaimer, the term of this patent is extended or adjusted under 35 U.S.C. 154(b) by 214 days.

(21) Appl. No.: 12/411,949

(22) Filed: Mar. 26, 2009

(51) Int. Cl.
*B60N 2/28* (2006.01)

(52) U.S. Cl. ..... 441/80

(58) Field of Classification Search ..... 114/124, 114/191–195, 357; 297/50.1; 441/80, 126–132
See application file for complete search history.

(56) References Cited

U.S. PATENT DOCUMENTS

| | | | | |
|---|---|---|---|---|
| 2,569,270 | A * | 9/1951 | Wilson | 114/133 |
| 3,990,384 | A * | 11/1976 | Reynolds, III | 114/126 |
| 4,175,786 | A * | 11/1979 | Schaller et al. | 297/254 |
| 4,725,253 | A | 2/1988 | Politte | |
| 5,292,175 | A | 3/1994 | Artz | |
| 5,409,411 | A | 4/1995 | Schrieber | |
| 5,514,020 | A | 5/1996 | Gainforth | |
| 5,516,233 | A | 5/1996 | Courtney | |
| 6,036,563 | A | 3/2000 | Walker | |
| 6,059,360 | A | 5/2000 | Bedard | |
| 6,170,910 | B1 | 1/2001 | Bapst | |
| 6,296,305 | B1 | 10/2001 | Lamka et al. | |
| 6,412,865 | B1 | 7/2002 | Bedard | |
| 6,482,060 | B1 | 11/2002 | Gorny et al. | |
| 6,530,725 | B1 | 3/2003 | Courtney et al. | |
| 6,558,082 | B1 | 5/2003 | Courtney et al. | |
| 6,589,089 | B1 | 7/2003 | Glass et al. | |
| 6,659,689 | B1 | 12/2003 | Courtney et al. | |
| 6,666,622 | B1 | 12/2003 | Courtney et al. | |
| 6,702,380 | B2 | 3/2004 | Bedard | |
| 6,715,830 | B2 | 4/2004 | Alexy | |
| 6,805,519 | B1 | 10/2004 | Courtney et al. | |
| 6,863,017 | B2 | 3/2005 | Charles et al. | |
| 7,008,281 | B2 | 3/2006 | Ketko | |
| 2005/0101202 | A1 | 5/2005 | Snell | |
| 2008/0045099 | A1 | 2/2008 | Ketko | |

FOREIGN PATENT DOCUMENTS

| | | | |
|---|---|---|---|
| WO | 0202398 | A1 | 1/2002 |
| WO | 0206114 | A1 | 1/2002 |

* cited by examiner

*Primary Examiner* — Edwin Swinehart
(74) *Attorney, Agent, or Firm* — McGarry Bair PC

(57) ABSTRACT

An infant flotation device for use in a marine environment comprises a body, having an outer surface defining a recessed area configured to receive an infant, and a hollow chamber opposed with the outer surface of the body and surrounded by the body. The body also defines a pivot mount that can extend into the cavity in juxtaposition with the outer surface. The infant flotation device further includes a swingable weight comprising a first end having an attachment mount pivotally received by the pivot mount for pivotal movement with respect to the body, and a second end having a weight thereon. The swingable weight can provide the infant flotation device with self-righting movement and stability.

26 Claims, 4 Drawing Sheets

INFANT FLOTATION DEVICE

BACKGROUND OF THE INVENTION

1. Field of the Invention

The invention generally relates to an infant flotation device for use in a marine environment.

2. Description of the Related Art

Flotation devices for adults and children in a marine environment typically take the form of a life preserver or jacket that is worn by the user for the purpose of maintaining the user at the surface of the water in the event that the user falls into the water. This type of life preserver does not work well for small children or infants weighing approximately 20 pounds or less. Infants and children weighing less than 20 pounds are likely to be unable to maintain an erect position and keep their head above the water when using this type of life preserver. The smallest life preserver approved by the United States Coast Guard is only rated for children over 20-22 pounds.

Several types of devices have been invented for use as flotation devices for infants and children weighing approximately 20 pounds or less. These devices are typically modified infant carrier or automotive safety seats that secure the passenger within the seat using one or more straps or harnesses, as is known in the art.

One type of seat relies on parts made from a buoyant material such as foam. For example, the devices disclosed in U.S. Pat. No. 7,008,281 and U.S. Patent Application No. 2005/0101202 consist of a flotation enhancing structure made from buoyant material, such as foam, that can be attached to an existing infant carrier or safety seat. U.S. Pat. No. 6,589,089 and WO0202398 both disclose seats having one or more parts made from or filled with buoyant foam. These types of seats all rely on the relative placement of buoyant material to maintain the seat and the passenger in an upright position in the water such that the passenger's head is above water.

Another type of seat incorporates a stationary ballast or weight into the seat to provide self-righting movement and stability to the device. For example, the seats disclosed in U.S. Pat. Nos. 4,725,253, 5,514,020, 6,296,305, 6,863,017, 6,715,830 and 6,702,380 include a carrier seat or safety seat modified with flotation material attached to the frame of the seat or hollow plastic housing to provide buoyancy. A stationary ballast weight can be situated below the seat's center of gravity to maintain the seat in an upright position in combination with the placement of buoyant material.

Yet another type of seat includes a ballast cavity that can be filled with a ballast material such as sand or water to provide stability to the seat. For example, U.S. Pat. No. 6,036,563 discloses a floating chair comprising a hollow body member to provide buoyancy and a separate hollow chamber that can be filled by the user with sand or water. U.S. Pat. No. 6,482,060 discloses an infant safety seat having parts made from buoyant material and ballast ports in the base of the seat. When the seat enters the water, water enters an empty space through the ballast ports. The ballast water provides stability to the seat in the water and maintains the seat in an upright position.

Flotation seats that incorporate the use of a ballast weight or chamber provide stability to the seat in the water and help to maintain the seat in an upright position in the water. Some seats, such as those disclosed in U.S. Pat. Nos. 6,296,305 and 6,482,060 incorporate a feature, such as a handle or canopy, in addition to the ballast weight into the seat to induce the seat to move into an upright position in the water if the seat enters the water such that the seat is not in an upright position. However, these seats rely on stationary ballast weights and features which may affect the rate at which the seat moves into an upright position in the water depending on manner in which the seat enters the water. The rate at which the seat enters an upright position in the water is critical as exposure of the passenger's airways to water leading to lack of oxygen or drowning may occur if the seat is maintained in a non-upright position for some length of time.

SUMMARY OF THE INVENTION

According to one embodiment of the invention, an infant flotation device for use in a marine environment comprises a body, having an outer surface defining a recessed area configured to receive an infant, and a hollow chamber opposed with the outer surface of the body, the body surrounding the hollow chamber. The body can define a pivot mount that can extend into the hollow chamber in juxtaposition with the outer surface. The infant flotation device further includes a swingable weight comprising a first end having an attachment mount pivotally received by the pivot mount for pivotal and lateral movement with respect to the body, and a second end having a weight thereon, wherein when the infant flotation device is inverted in a body of water, the swingable weight pivots to an off center position, which causes the infant flotation device to right itself as the swingable weight moves laterally toward a centered area of the infant flotation device.

According to another embodiment of the invention, the swingable weight can rotate with respect to the body through a range of motion greater than 0 degrees and less than 360 degrees.

In still another embodiment of the invention, when the flotation device is sitting in a body of water in an upright position, the swingable weight can fall to a downward position to balance the flotation device in the body of water and keeps at least a head of an infant located in the recessed area from being submerged in the body of water. When the flotation device is sent into a body of water in a capsized position, the swingable weight can pivot, at least assisted by gravity, toward the body of water. This movement can cause the flotation device to rotate in the body of water toward an upright position and position at least a head of an infant located in the recessed area out of the water.

According to yet another embodiment, the pivot mount can be located on a longitudinal medial axis of the body. The pivot mount can also be located on an axis of the body passing through a center of mass of the body. The pivot mount can additionally be located on an axis of the body passing through a center of mass of the body with an infant located in the recessed area.

According to still another embodiment of the invention, the body can have at least one leg positioned adjacent a first and second end of the body along a longitudinal axis of the body for positioning the recessed area in a generally inclined position. The body can also include at least one safety restraint adapted to secure the infant to the recessed area.

In another embodiment of the invention, a padded material can be mounted within the recessed area to enhance the comfort of an infant placed in the recessed area. The padded material can also be formed of a buoyant material to enhance the buoyancy of the body.

According to another embodiment of the invention, the body with the attached swingable weight can have a minimum buoyancy of 7 pounds.

According to yet another embodiment of the invention, the second end of the swingable weight can be attached to the attachment mount of the first end by a rigid member. The weight on the second end of the swingable weight can be a solid member. The weight on the second end of the swingable weight can also be filled with a ballast material.

According to another embodiment of the invention, when the flotation device enters a body of water in a generally upside down position, whereby the recessed area is facing the water, the swingable weight can rotate to one side of the flotation device. The movement of the weight can shift the center of gravity of the flotation device away from an axis of rotation of the flotation device. The movement of the swingable weight can provide momentum to the flotation device to rotate about its axis of rotation to a position in which the center of gravity of the flotation device is located below the axis of rotation. This can provide a self-righting movement to the body and move the body to an upright position.

According to yet another embodiment of the invention, an infant flotation device for use in a marine environment comprises a body, having an outer surface defining a recessed area configured to receive an infant, and a hollow chamber opposed with the outer surface of the body, the body surrounding the hollow chamber. At least one moveable weight can be located within the hollow chamber, wherein when the infant flotation device is inverted in a body of water, the at least one moveable weight moves to an off center position, which causes the infant flotation device to right itself as the at least one moveable weight moves laterally toward a centered area of the infant flotation device.

According to another embodiment of the invention, the hollow chamber can have a generally arcuate configuration, which extends from the body to its greatest extent along a longitudinal axis of the body.

According to still another embodiment, the at least one moveable weight can travel along the hollow chamber toward a downward position to provide a rotational force to the body to return the body to an upright position. The at least one moveable weight can be a solid member. The at least one moveable weight can also be filled with a ballast material.

According to another embodiment, when the flotation device enters a body of water in a generally upside down position whereby the recessed area is facing the water, the at least one moveable weight can move to one side of the flotation device, wherein the movement of the at least one moveable weight shifts the center of gravity of the flotation device away from an axis of rotation of the flotation device. The movement of the at least one moveable weight provides momentum to the flotation device to rotate about its axis of rotation to a position in which the center of gravity of the flotation device is located below the axis of rotation, thus providing a self-righting movement to the body and moving the body to an upright position. The infant flotation device can further comprise a buoyant material located between the outer surface of the body and the hollow chamber.

DESCRIPTION OF THE PREFERRED EMBODIMENT

Figure 1:
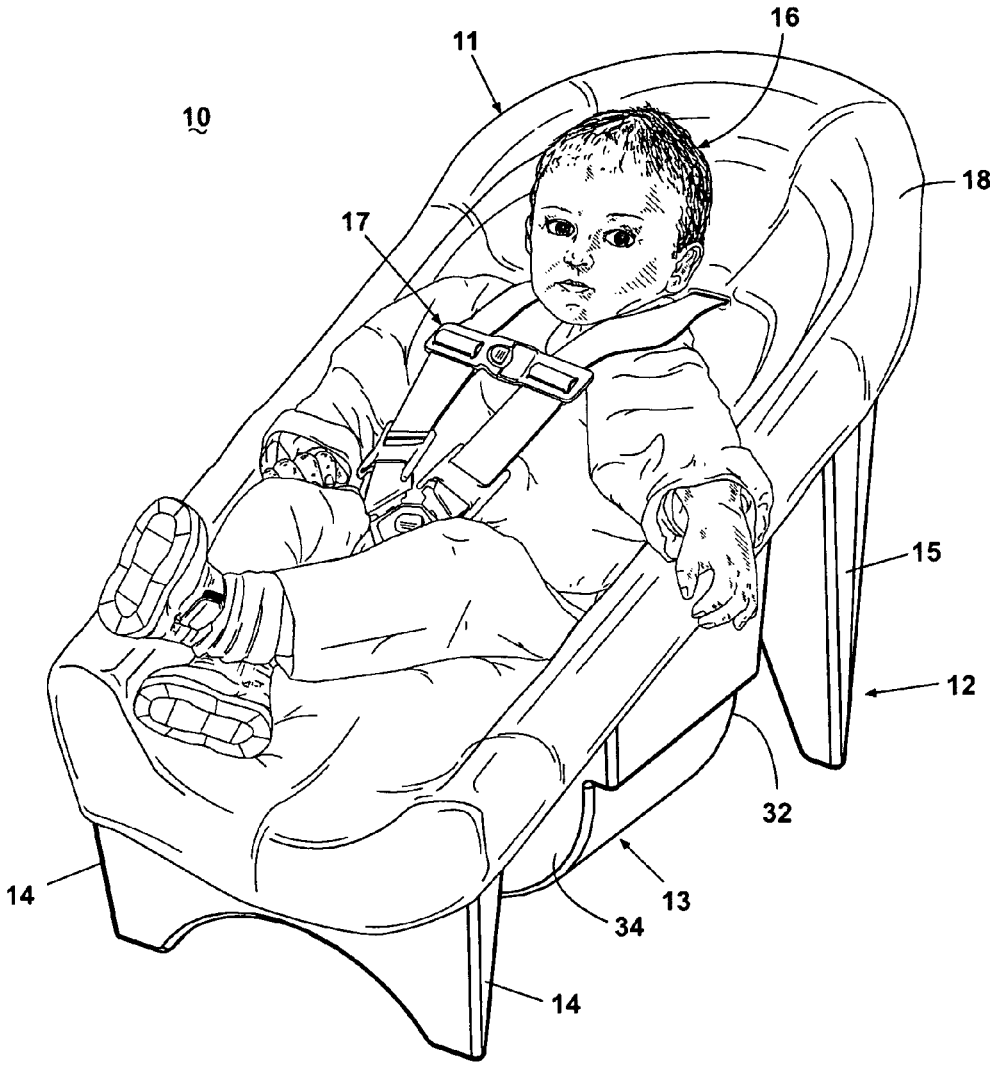
FIGS. 1 and 2 are perspective views of an infant flotation device according to an embodiment of the invention.

FIG. 1 illustrates an infant flotation device 10 having a seat portion 11 and a housing 12 comprising a ballast chamber 13 and a pair of front and rear support legs 14, 15. A passenger 16 can be an infant or small child weighing less than 20-22 pounds, and can be secured to the seat portion 11 through restraints 17 in the form of a three-point harness. The seat portion 11 can be provided with a cushion or soft material 18 to improve the comfort of the infant 16.

Figure 2:
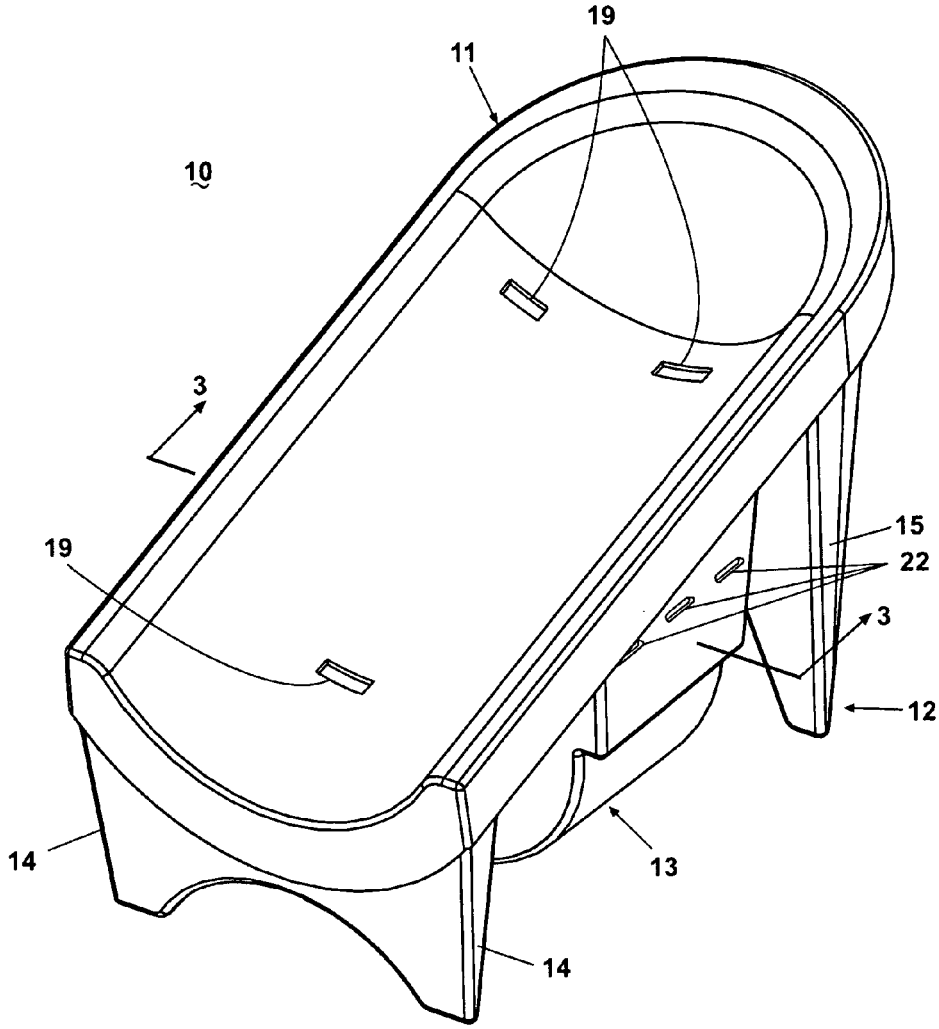

Referring now to FIG. 2, the seat portion 11 can be provided with restraint apertures 19 for receiving the restraints 17. The number and position of the restraint apertures 19 are not germane to the invention and can vary depending on the type of restraints 17. For example, the restraints 17 can be a three-point harness, as illustrated. Alternatively, the restraints 17 can be provided in the form of a five-point harness, such as is used in automotive infant safety seats.

Figure 3:
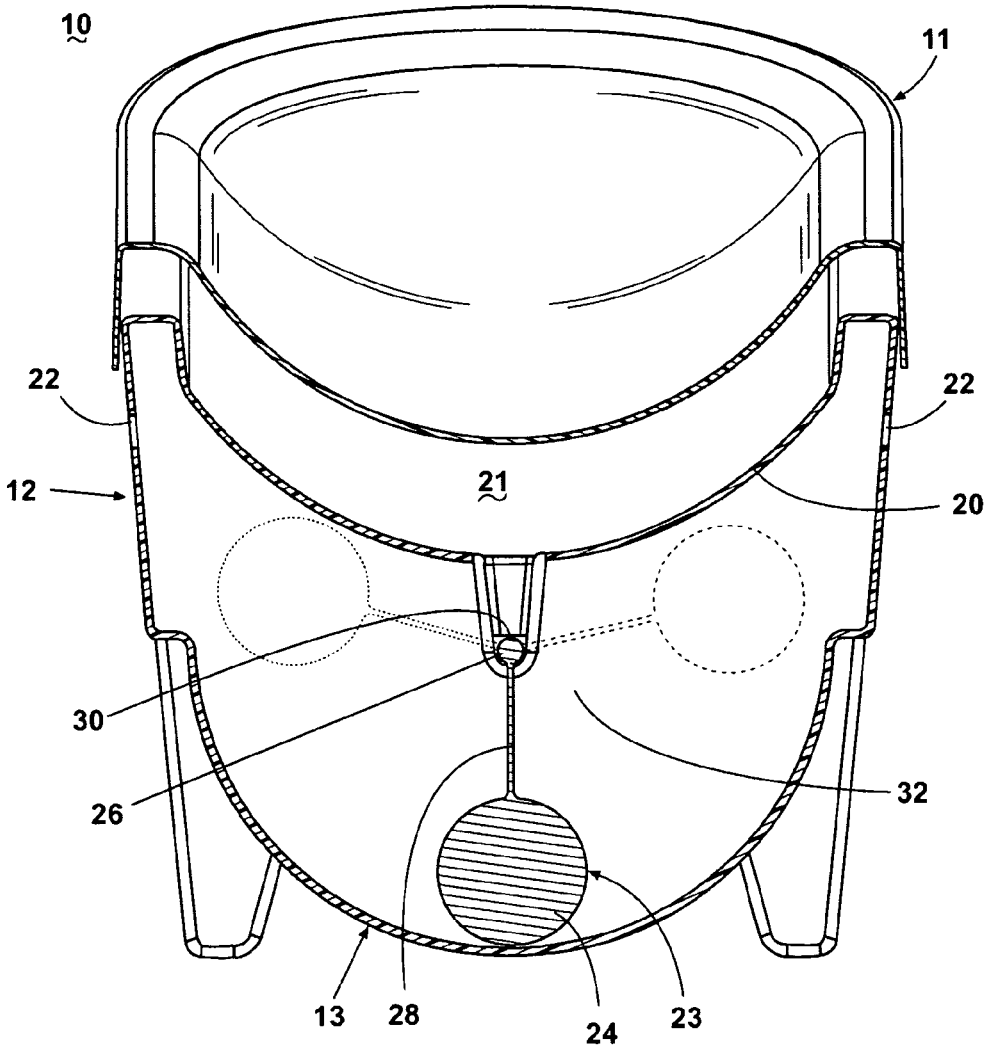
FIG. 3 is a cross-section of the infant flotation device of FIG. 2 along the lines II-II.

Referring now to FIG. 3, the housing 12 can include an upper portion 20 located above the ballast chamber 13 and below the seat portion 11. The upper portion 20 and the seat portion 11 can define a cavity 21 for receiving buoyant material. The buoyant material can be any suitable material such as one or more layers of buoyant foam or air bladders. Alternatively, the buoyant material can be in the form of blown foam that is injected into the cavity 21.

The seat portion 11, the housing 12 and the front and rear support legs 14, 15 can be made from plastic. The housing 12 and the front and rear support legs 14, 15 can be integrally formed from a single mold. Alternatively, the seat portion 11, the housing 12 and the front and rear support legs 14, 15 can be formed separately and assembled using mechanical fasteners, such as pins or screws, or non-mechanical fasteners such as an adhesive or by ultra-sonic welding. The seat portion 11 can be secured to the housing 12 using any suitable non-mechanical fastener, such as an adhesive or an ultrasonic weld.

The ballast chamber 13 can be provided with one or more apertures 22 irregularly or regularly spaced around the perimeter of the ballast chamber 13 to allow some amount of water to enter the ballast chamber 13. Alternatively, the ballast chamber 13 can be provided such that is water-tight for preventing or minimizing the amount of water that can enter the ballast chamber 13. The number and locations of the apertures 22 can be selected to allow the desired level of water to enter the ballast chamber 13 when the flotation device 10 is in the water.

Still referring to FIG. 3, a swinging ballast member 23 is provided within the ballast chamber 13. The ballast member 23 comprises a weight 24 connected with a swing arm 26 by a connecting member 28. The swing arm 26 is pivotally mounted in a mounting aperture 30 located in a first wall 32 of the housing 12 such that the weight 24 can pivot around a horizontal axis that runs between the front and rear support legs 14, 15. Alternatively, the ballast member 23 can be rotatably mounted in a second wall 34 of the housing 12 opposite the first wall 32. In addition, the swing arm 26 can be rotatably mounted at a first end in the first wall 32 and at a second end opposite the first end in the second wall 34.

The size of the weight 24 and the connecting member 28 are selected such that the weight 24 can freely rotate within the ballast chamber 13 from an angle slightly greater than 90 degrees from the horizontal axis to an angle slight greater than −90 degrees from the horizontal axis as illustrated in dashed lines in FIG. 3.

The swinging ballast member 23 can be made from plastic or metal. Alternatively, the different parts of the ballast member 23 can be made from different materials. For example, the weight 24, the swing arm 26 and the connecting arm 28 can be made from plastic. In this case, the weight 24 can comprise a hollow plastic housing filled with a ballast material such as sand or metal shot. Alternatively, the swing arm 26 and the connecting arm 28 can be made from plastic and the weight 24 can comprise a solid metal form. For example, the weight 24 may comprise a solid piece of iron.

The combination of the buoyant material within the cavity 21 and the swinging ballast member 23 provides a self-righting flotation device 10 capable of keeping an infant's head above a surface of a body of water. The amount and type of buoyant material within the cavity 21 can be selected to provide the desired amount of buoyancy to the flotation device 10. The desired amount of buoyancy can be determined based on state and/or federal requirements. For example, the United States Coast Guard requires that an infant or child personal flotation device have a minimum inherent buoyancy of 7 pounds.

FIGS. 4A through 4D illustrate the self-righting movement of the flotation device 10 when it enters a body of water 40 in a capsized position, i.e. any position in which the surface of the seat portion 11 is not in an upright position, according to an embodiment of the invention. If an infant 16 is present in the flotation device 10, the self-righting movement ensures that the infant's face is not submerged under the surface of the water 40.

Figure 4B:
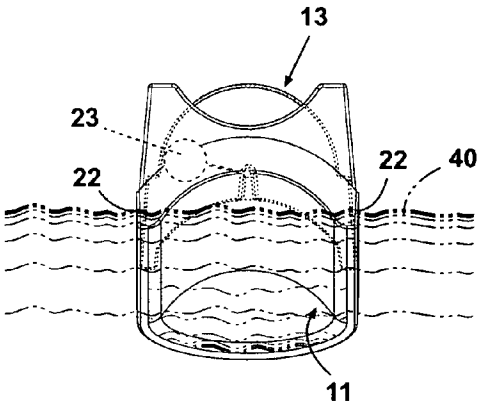
FIGS. 4A-4D illustrate the self-righting motion of the infant flotation device of FIG. 1 according to an embodiment of the invention.
Figure 4D:
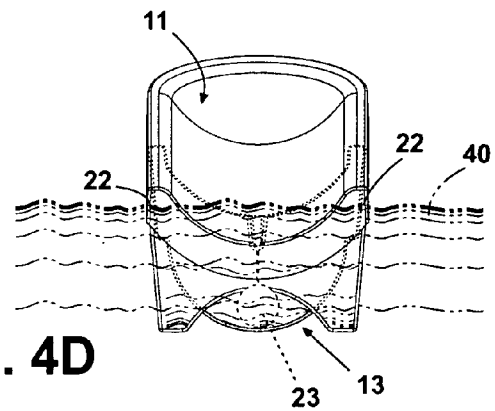
Figure 4A:
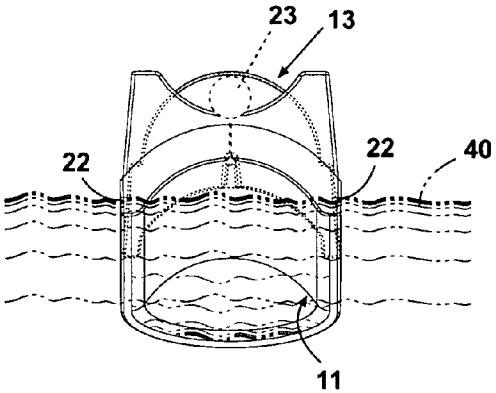

While not intending to be limited by any theory, when the flotation device 10 enters the water in a generally upside-down, capsized position, as illustrated in FIG. 4A, the weight 24 can pivot on the swing arm 26 to one side of the flotation device 10 as illustrated in FIG. 4B. The movement of the weight 24 shifts the center of gravity of the flotation device 10 away from the axis of rotation of the flotation device 10. This movement can provide momentum to the flotation device 10 to rotate about its axis of rotation to a position in which the center of gravity of the flotation device 10 is located below the axis of rotation, as illustrated in FIGS. 4C and 4D.

Figure 4C:
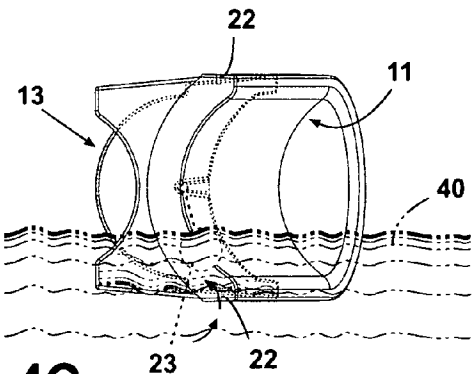

As the flotation device 10 starts to rotate with respect to the body of water 40 as shown in FIGS. 4B though 4D, water can enter the ballast chamber 13 through the apertures 22 as illustrated by the arrows in FIG. 4C. As the water enters the ballast chamber 13, the weight of the water can contribute to the momentum of the flotation device 10 as it moves to an upright position in the body of water 40.

The swinging ballast member 23 can provide the flotation device 10 with the ability to rapidly move into an upright position in a body of water regardless of how the flotation device 10 enters the body of water. It will be understood that the swinging ballast member 23 shown in the example embodiments herein can be any type of moveable weight which travels within the ballast chamber 13 to provide a rotational force to the flotation device 10 to return it to an upright position. In addition, while the ballast member 23 is described as a swinging member attached to the ballast chamber 13 by a swing arm 26, other examples of the ballast member 23 are contemplated within the scope of this invention.

For example, the ballast member 23 can comprise one or more weights positioned within one or more tracks in which the weights can slide or roll toward a downward position, providing a rotational force to the flotation device to return it to an upright position. In another example, the ballast member 23 can comprise one or more freely moving weights, unattached to the ballast chamber 13, which fall by gravity toward a downward position, providing a rotational force to the flotation device to return it to an upright position.

An additional benefit of the swinging ballast member 23 is that the movement of the weight 24 can provide momentum to the flotation device 10 to increase the rate at which it comes to an upright position in the water 40. The speed at which the flotation device 10 comes to an upright position is important in ensuring that the infant's face is not submerged under the surface of the water for any significant length of time, which may lead to injury due to lack of oxygen or drowning. The weight 24 also provides stability to the infant flotation device 10 when it is in an upright position.

The weight of the water that enters the ballast chamber 13 through the apertures 22 can also contribute to the stability of the infant flotation device when it is in an upright position. The weight 24 and the weight of the water can provide enough weight to maintain the flotation device 10 at a position relative to the surface of the water such that some portions of the seat portion 11 and housing 12 are below the surface of the water while the infant's head is maintained above the surface of the water. This positioning of the flotation device 10 relative to the surface of the water can minimize the likelihood that the flotation device 10 will capsize while floating the water.

While the invention has been specifically described in connection with certain specific embodiments thereof, it is to be understood that this is by way of illustration and not of limitation, and the scope of the appended claims should be construed as broadly as the prior art will permit.

What is claimed is:

1. An infant flotation device for use in a marine environment comprising:

a body, having an outer surface defining a recessed area configured to receive an infant;

a hollow chamber opposed with the outer surface, the body surrounding the hollow chamber, the body also defining a pivot mount extending into the hollow chamber in juxtaposition with the outer surface; and a swingable weight comprising a first end having an attachment mount pivotally received by the pivot mount for pivotal and lateral movement with respect to the body, and a second end having a weight thereon;

wherein when the infant flotation device is inverted in a body of water, the swingable weight pivots to an off center position, which causes the infant flotation device to right itself as the swingable weight moves laterally toward a centered area of the infant flotation device.

2. The infant flotation device of claim 1 wherein the swingable weight can rotate with respect to the body through a range of motion greater than 0 degrees and less than 360 degrees.

3. The infant flotation device of claim 1 wherein when the flotation device is sitting in a body of water in an upright position, the swingable weight falls to a downward position to balance the flotation device in the body of water and keeps at least a head of an infant located in the recessed area from being submerged in the body of water.

4. The infant flotation device of claim 1 wherein; when the flotation device is sent into a body of water in a capsized position, the swingable weight will pivot, at least assisted by gravity, toward the body of water, which causes the flotation device to rotate in the body of water toward an upright position and position at least a head of an infant located in the recessed area out of the water.

5. The infant flotation device of claim 1 wherein the pivot mount is located on a longitudinal medial axis of the body.

6. The infant flotation device of claim 1 wherein the pivot mount is located on an axis of the body passing through a center of mass of the body.

7. The infant flotation device of claim 1 wherein the pivot mount is located on an axis of the body passing through a center of mass of the body with an infant located in the recessed area.

8. The infant flotation device of claim 1 wherein the body has at least one leg positioned adjacent a first and second end of the body along a longitudinal axis of the body for positioning the recessed area in a generally inclined position.

9. The infant flotation device of claim 1 and further comprising at least one safety restraint attached to the body and adapted to secure an infant to the recessed area.

10. The infant flotation device of claim 1 and further comprising a padded material mounted within the recessed area to enhance the comfort of an infant placed in the recessed area.

11. The infant flotation device of claim 1 and further comprising a buoyant material on an inner surface of the body between the hollow chamber and the recessed area to enhance the buoyancy of the body.

12. The infant flotation device of claim 11 wherein the body with the attached swingable weight has a minimum inherent buoyancy of 7 pounds.

13. The infant flotation device of claim 1 wherein the body has at least one aperture for allowing water to enter the hollow chamber to maintain the flotation device at a position relative to a surface of the water such that at least a portion of the body is below the surface of the water and at least a head of an infant located in the recessed area is above the surface of the water.

14. The infant flotation device of claim 1 wherein the weight on the second end of the swingable weight is attached to the attachment mount of the first end by a rigid member.

15. The infant flotation device of claim 1 wherein the weight on the second end of the swingable weight is a solid member.

16. The infant flotation device of claim 1 wherein the weight on the second end of the swingable weight is filled with a ballast material.

17. The infant flotation device of claim 1 wherein when the flotation device enters a body of water in a generally upside down position whereby the recessed area is facing the water, the swingable weight can rotate to one side of the flotation device, wherein the movement of the weight shifts the center of gravity of the flotation device away from an axis of rotation of the flotation device.

18. The infant flotation device of claim 17 wherein the movement of the swingable weight provides momentum to the flotation device to rotate about its axis of rotation to a position in which the center of gravity of the flotation device is located below the axis of rotation, thus providing a self-righting movement to the body and moving the body to an upright position.

19. An infant flotation device for use in a marine environment comprising:

a body, having an outer surface defining a recessed area configured to receive an infant;

a hollow chamber opposed with the outer surface, the body surrounding the hollow chamber; and at least one moveable weight located within the hollow chamber;

wherein when the infant flotation device is inverted in a body of water, the at least one moveable weight moves to an off center position, which causes the infant flotation device to right itself as the at least one moveable weight moves laterally toward a centered area of the infant flotation device.

20. The infant flotation device of claim 19 wherein the hollow chamber has a generally arcuate configuration, which extends from the body to its greatest extent along a longitudinal axis of the body.

21. The infant flotation device of claim 19 wherein the at least one moveable weight can travel along the hollow chamber toward a downward position to provide a rotational force to the body to return the body to an upright position.

22. The infant flotation device of claim 19 wherein the at least one moveable weight is a solid member.

23. The infant flotation device of claim 19 wherein the at least one moveable weight is filled with a ballast material.

24. The infant flotation device of claim 19 wherein when the flotation device enters a body of water in a generally upside down position whereby the recessed area is facing the water, the at least one moveable weight can move to one side of the flotation device, wherein the movement of the at least one moveable weight shifts the center of gravity of the flotation device away from an axis of rotation of the flotation device.

25. The infant flotation device of claim 24 wherein the movement of the at least one moveable weight provides momentum to the flotation device to rotate about its axis of rotation to a position in which the center of gravity of the flotation device is located below the axis of rotation, thus providing a self-righting movement to the body and moving the body to an upright position.

26. The infant flotation device of claim 25 and further comprising buoyant material located between the outer surface of the body and the hollow chamber.

* * * * *